US005647292A

United States Patent [19]

Morgulis et al.

[11] Patent Number: 5,647,292

[45] Date of Patent: Jul. 15, 1997

[54] SEWING APPARATUS WITH TURNTABLE FOR HOLDING FABRIC

[75] Inventors: Lazar A. Morgulis, Norcross; Charles Zimmerman, Suwanee, both of Ga.

[73] Assignee: Juki American, Inc., Suwanee, Ga.

[21] Appl. No.: 397,492

[22] Filed: Mar. 2, 1995

[51] Int. Cl.[6] ..... D05B 3/04

[52] U.S. Cl. ..... 112/470.17; 112/10; 112/309

[58] Field of Search ..... 112/12, 13, 14, 112/10, 470.17, 309, 475.08, 470.14

[56] References Cited

U.S. PATENT DOCUMENTS 4,240,366 12/1980 Smith ..... 112/470.17 X
5,024,174 6/1991 Ferguson ..... 112/470.17
5,379,708 1/1995 Moll et al. ..... 112/470.17

*Primary Examiner*—Paul C. Lewis
*Attorney, Agent, or Firm*—Morgan & Finnegan, L.L.P.

[57] ABSTRACT

An apparatus for sewing has a sewing head with a stitching station at which stitching occurs on material fed therethrough. A turntable holds material to be stitched in its position adjacent to the sewing head. The turntable has an outer perimeter with a portion of the outer perimeter extending through the stitching station. Fabric material is held along the perimeter and stitched as the turntable rotates so that during stitching the turntable rotates and feeds material into the stitching station of the sewing head. In a preferred embodiment, the turntable includes upper and lower platens and magnets positioned on the upper platen for locking upper and lower platens together and holding fabric material therebetween.

33 Claims, 5 Drawing Sheets

SEWING APPARATUS WITH TURNTABLE FOR HOLDING FABRIC

FIELD OF THE INVENTION

This invention relates to an apparatus for sewing where a turntable holds fabric material for feeding into a stitching station of a sewing head.

BACKGROUND OF THE INVENTION

Large pieces of fabric material, such as airbags, often require complicated holding fixtures during a stitching operation on commercial sewing machines to insure economical and cost productive stitching of the material. Many of these larger pieces of fabric material require stitching in a circular pattern, such as on an airbag, to form a circumferential or perimeter stitch around the desired piece. For example, an airbag requires a circumferential stitch around its perimeter to close the bag.

Many of the common fixtures for holding these larger fabric pieces, such as conventional clamps and other holdings fixtures, make peripheral and circumferential stitching difficult. It would be advantageous if a simple mechanical apparatus having few linearly moving parts could be used for holding large pieces of fabric, such as airbags, and moving the piece into the stitching station during a stitching operation while also facilitating circumferential stitching around the piece. Such apparatus would also require a means for holding the fabric piece tightly.

SUMMARY OF THE INVENTION

In accordance with the present invention, the apparatus for sewing includes a sewing head having a stitching station at which stitching occurs on a fabric material fed therethrough such as an airbag. A turntable holds the fabric material to be stitched and is positioned adjacent to the sewing head. The turntable has a circular configured outer perimeter. A portion of the outer perimeter extends through the stitching station. The turntable holds the fabric material to be stitched along the perimeter of the turntable and is rotatable so that during stitching the turntable rotates and feeds the fabric material positioned along the perimeter of the turntable into the stitching station of the sewing head.

In one aspect of the present invention, the turntable is freely rotatable so that as the sewing head draws material through the stitching station, the turntable is rotated. In another aspect of the present invention, the turntable can be driven to feed material through the stitching station.

In still another aspect of the present invention, the turntable includes upper and lower platens, and electromagnets positioned on the upper platen for attracting the platens to each other and holding fabric material to be stitched tightly between the platens. The turntable can be moved linearly toward and away from the sewing head so that the sewing head can be serviced. The turntable and sewing head are mounted on a table support.

In yet another aspect of the present invention, the turntable includes a horizontally configured support plate and a vertically aligned lower support shaft rotatably mounted on the support plate. The lower platen is secured on the support shaft and horizontally aligned thereon. The lower platen has an outer perimeter and the shaft and platen are positioned so that a portion of the outer perimeter of the platen extends through the stitching station.

A support arm is secured to the support plate and includes a bridge arm extending above the lower platen. An upper support shaft is rotatably supported on the bridge arm and vertically aligned with the lower support shaft. An upper platen is secured to the upper support shaft and the upper platen has an outer perimeter aligned with the perimeter of the lower platen. The upper support shaft is extended to lower the upper platen into overlapping engagement with the lower platen.

In still another aspect of the present invention, the support arm is pivotally mounted on the support plate to allow the upper platen to be pivotally moved away from the lower platen and enable loading of fabric material to be stitched onto the lower platen. The movement means in one embodiment comprises a cylinder and piston. The support plate is mounted for linear movement on a pair of linear bearing rails by linear bearings secured to the support plate.

Electrical contact brushes can be positioned on the upper shaft to engage a metallic ring through which electrical current can be drawn for transmission to the electromagnets positioned on the upper platen. The lower support shaft can include a gear and timing belt mechanism so that the lower platen can be rotated and driven independent of the force derived from the sewing head as the sewing head draws material through the stitching station.

DESCRIPTION OF THE DRAWINGS

The advantages and features of the present invention will be appreciated more fully from the following description, with reference to the accompanying drawings in which.

DETAILED DESCRIPTION OF THE INVENTION

Figure 1:
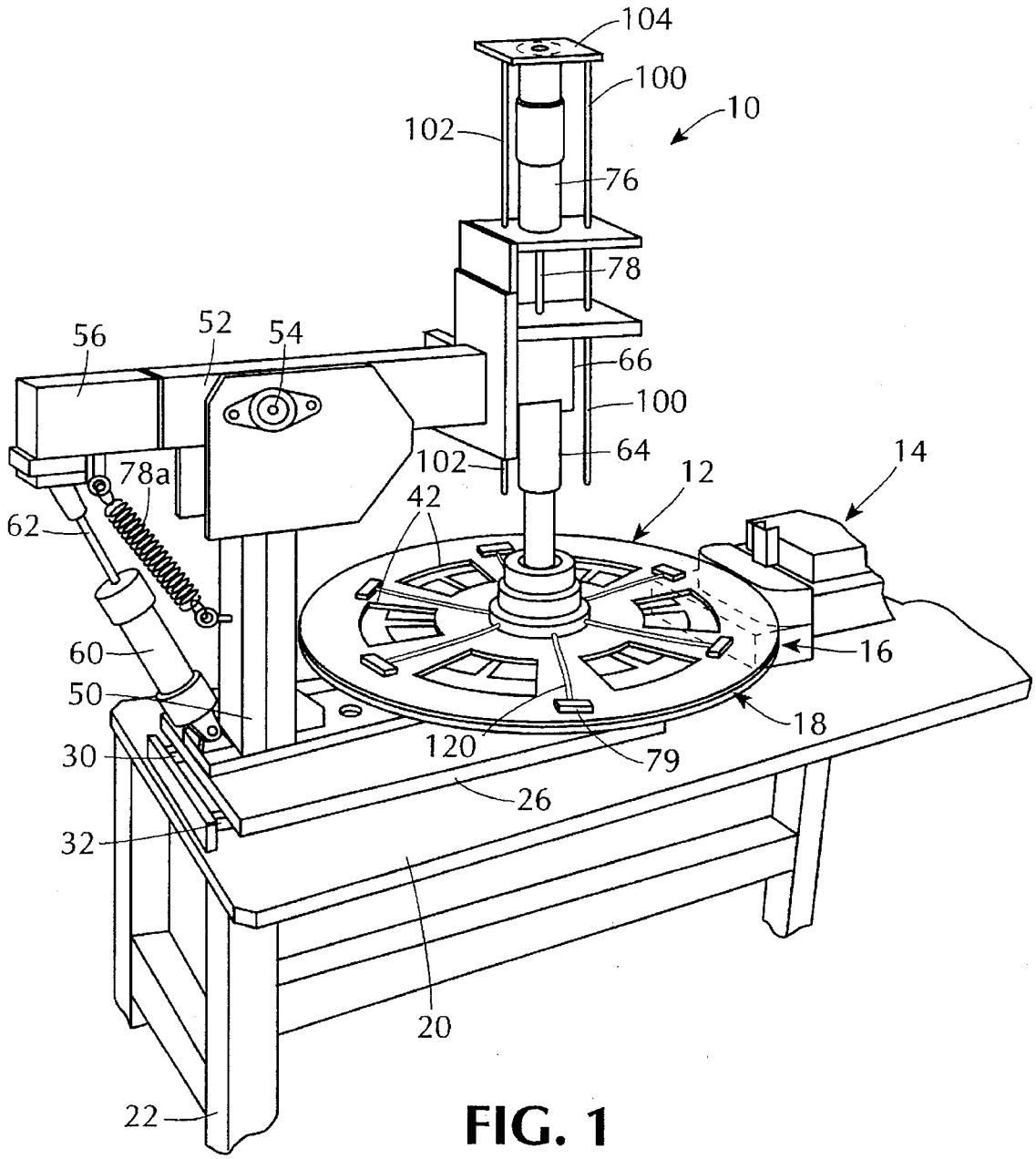
FIG. 1 is a schematic perspective view of the sewing apparatus showing the turntable for holding material to be stitched.
Figure 2:
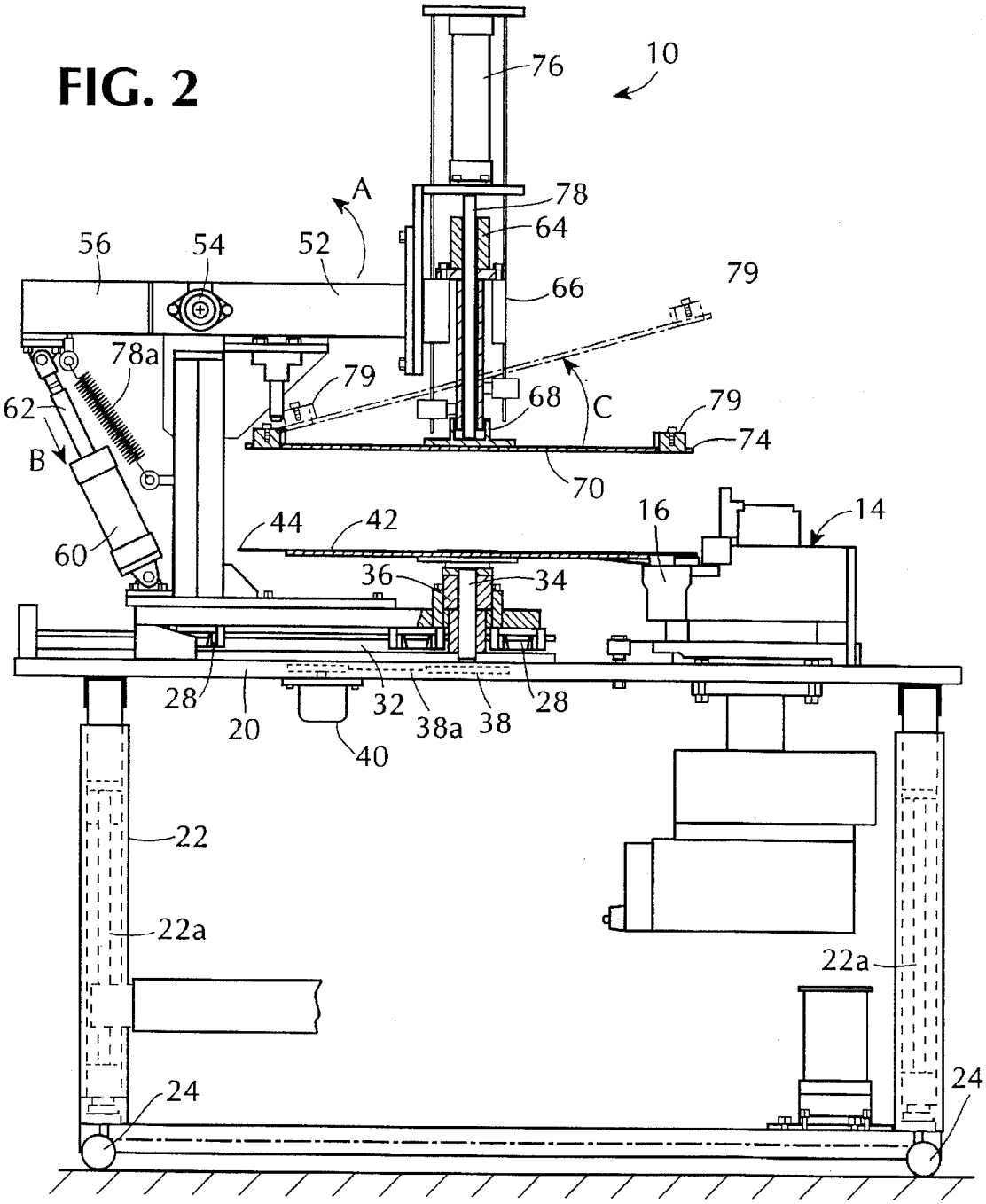
FIG. 2 is a schematic side elevation view of the sewing apparatus in greater detail in accordance with the present invention.

Referring now to FIGS. 1 and 2, an apparatus for stitching fabric pieces in accordance with the present invention is illustrated generally at 10, and includes a turntable, indicated generally at 12, which is positioned adjacent a sewing head indicated at 14. The sewing head 14 has a stitching station 16 through which fabric moves and is stitched. The turntable 12 has a circular configured, outer perimeter, indicated at 18, with a portion of the outer perimeter 18 extending through the stitching station 16. Although the illustrated turntable 12 is circular, almost any configuration can be used depending on the fabric material which must be stitched. The turntable 12 holds fabric material to be stitched and rotates so that during stitching the turntable feeds fabric material into the stitching station 16 of the sewing head 14.

As shown in FIGS. 1 and 2, the sewing head 14 and turntable 12 are mounted on a table 20 which includes legs 22 having a lifting mechanism **22*a*, such as piston and cylinder mechanism, for extending the length of the legs 22** and moving the entire table 20 to a desired vertical height. The legs 22 include wheels 24 (FIG. 2), which allow the table 20 be moved from location to location as production requires. In the illustrated embodiment, the sewing head 14 is a standard safety overlock stitch machine and includes a stitching station 16 at which stitching cccurs. Other sewing heads can be used depending on the stitching requirements.

Figure 3:
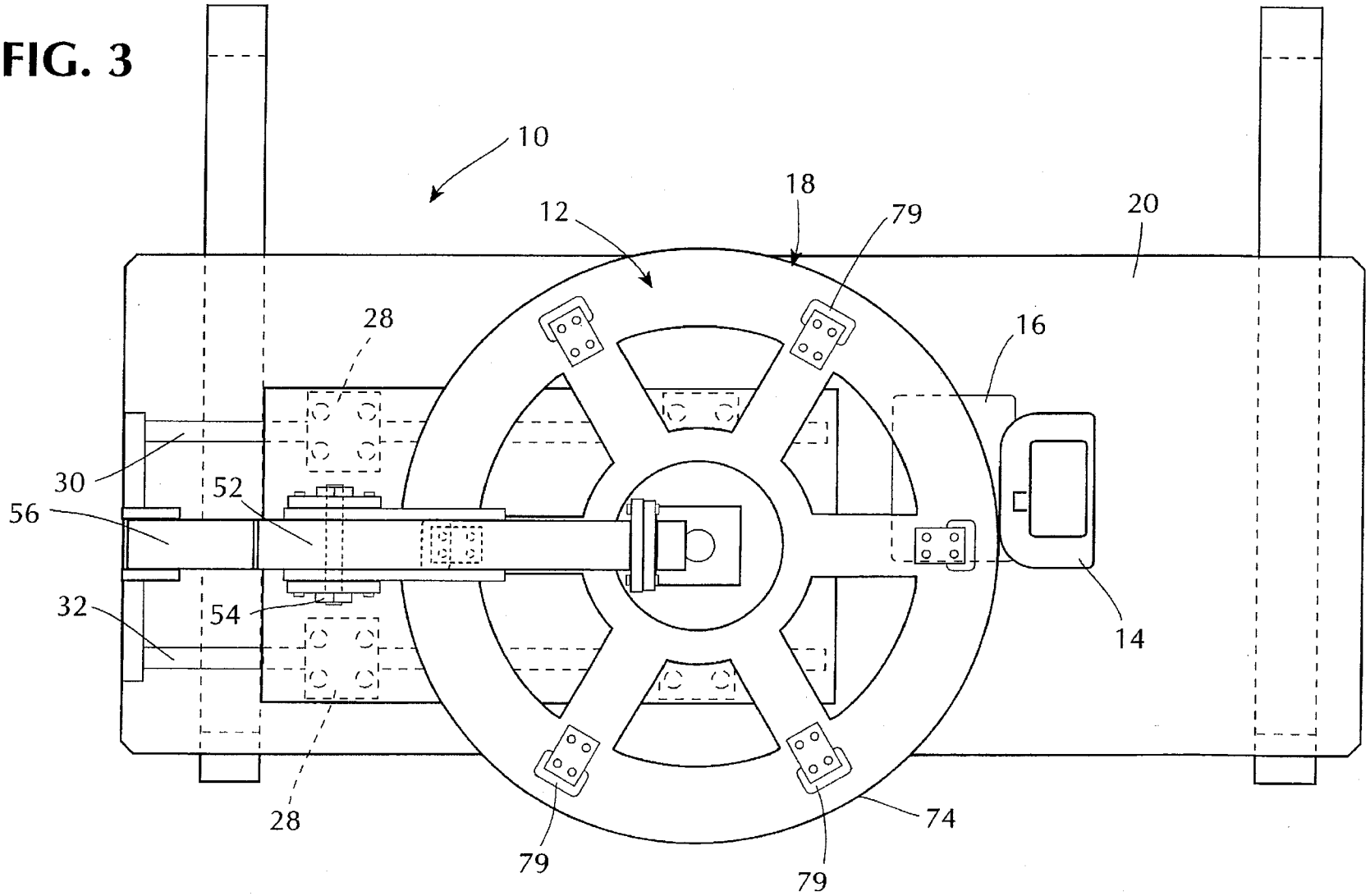
FIG. 3 is a schematic plan view of the sewing apparatus in accordance with the present invention.

Referring now to FIGS. 1 and 3 greater details of the turntable 12 are shown and described below. The turntable 12 includes a horizontally configured support plate 26 having linear bearings 28 secured on the underside thereof. Two parallel spaced linear bearing rails 30, 32 are mounted on the table 20 and spaced to receive the linear bearings 28 secured on the underside of the support plate 26. The bearing rails 30, 32 extend from a position adjacent the stitching station 16 of the sewing head 14 across the table 20 as shown in FIG. 3.

A vertically oriented, lower support shaft 34 is rotatably mounted on the support plate 26 by thrust washers and radial bearings (not shown in detail). The lower support shaft 34, thrust washers and radial bearings are received within a TEFLON synthetic resin polymer block 36 mounted on the support plate 26 to allow free rotation of the lower support shaft 34. At the bottom portion of the lower support shaft, a timing belt pulley 38 is connected thereto and connects by a belt pulley 38*a* to an optional motor assembly 40 which drives the lower support shaft 34.

A circular configured lower platen 42 is secured on the top portion of the lower support shaft 34 and is horizontally aligned as shown in FIG. 2. The lower platen 42 has an outer perimeter 44 and the lower support shaft 34 and platen 42 are positioned so that a portion of the outer perimeter 44 of the platen 42 extends through the stitching station 16 as shown in FIG. 3. The lower platen 42 is formed from a magnetic steel so that it can be attracted by magnetic forces.

A vertically oriented support arm 50 is fixed to the rear portion of the support plate 26 and includes an upper bridge arm 52 extending above the lower platen 42. The vertical support arm 52 is rigid and pivotally mounts the bridge arm 52 as shown in FIG. 2 by a pin assembly 54 so that the bridge arm can be pivoted about the pin assembly 54 in the direction of arrow A. A counterweight 56 extends past the rear of the bridge arm 52 and has a first pneumatic cylinder 60 connected to the support plate 26 adjacent the lower portion of the support arm 50 and the end of the counterweight 56. When the piston 62 of the pneumatic cylinder 62 is retracted, the bridge arm 52 is pivoted upward and away from the lower platen 42 in the direction of arrow B.

Figure 4:
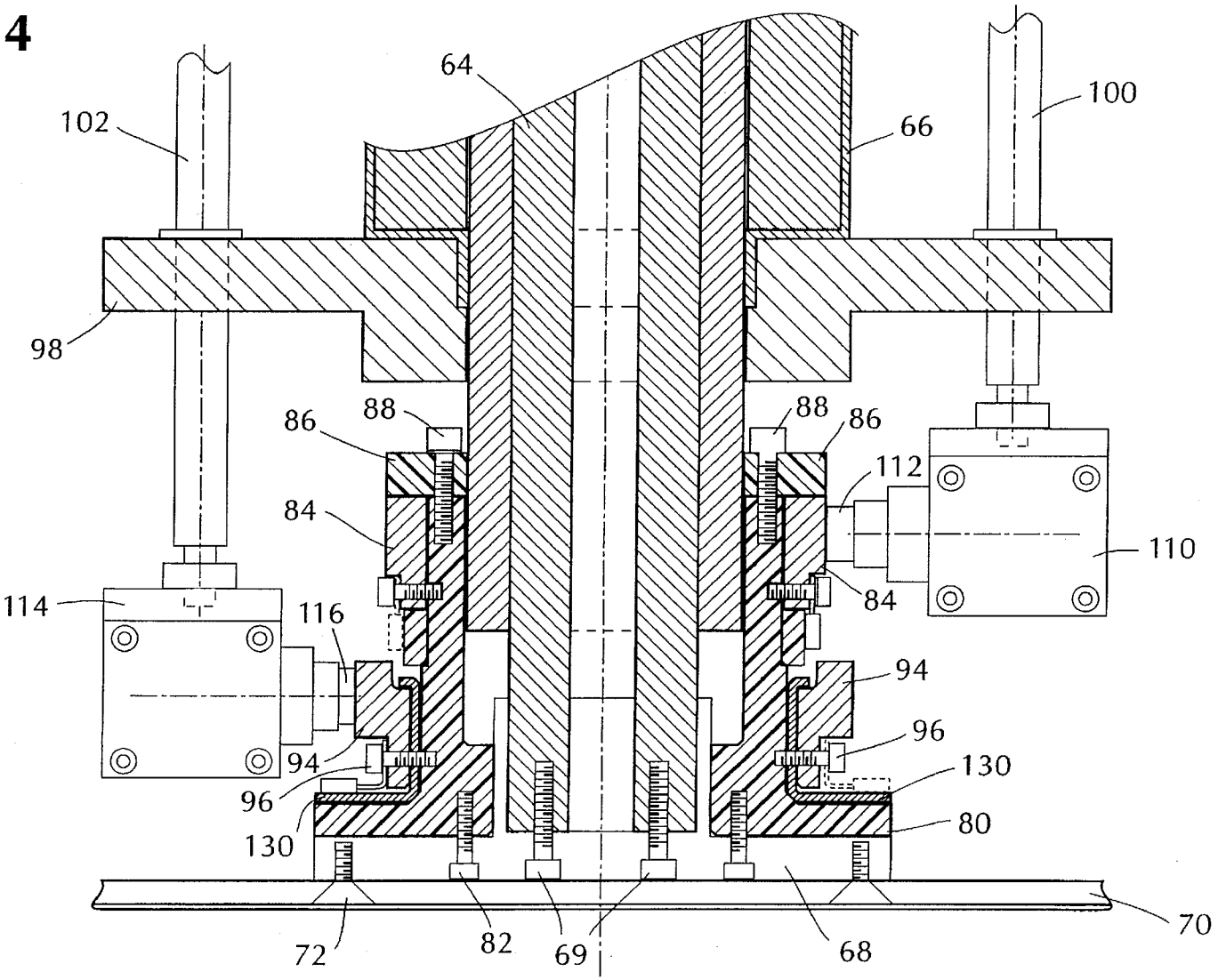
FIG. 4 is a sectional view showing in greater detail the upper platen secured to the upper support shaft and the brush holders, brushes, and conducting rings.

At the end of the bridge arm 52 opposing the counterweight 56, an upper support shaft 64 is rotatably supported and vertically aligned with the lower support shaft 34 as shown in FIG. 2. The upper support shaft 64 is mounted within a TEFLON housing 66 and freely rotatable therein by suitable bearings (not shown in detail). The bottom portion of the upper support shaft 64 includes a mounting fixture 68 secured by bolts 69 to the shaft 64. An upper platen 70 is secured by fasteners 72 such as bolts to the mounting fixture 68 (FIG. 4). The upper platen 70 has an outer perimeter 74 aligned with the outer perimeter 44 of the lower platen 42 (FIG. 2).

A second pneumatic cylinder 76 connects to the upper support shaft 64 and upon extension of its piston 78, moves the upper support shaft 64 downward so as to move the upper platen 70 into overlapping engagement with the lower platen 42. The second pneumatic cylinder 76 has about a six inch cavity stroke so that the upper platen 70 can be raised or lowered as desired. The counter weight 56 balances the second pneumatic cylinder 76, upper support shaft 64 and upper platen 70. A spring shock absorber 78*a* is connected between the counterweight 56 and a medial portion of the vertical support arm 50 so that when the piston 62 of the first pneumatic cylinder 60 is retracted or extended, the driving force is damped to prevent mechanical damage and lessen the pivoting speed. FIG. 2 illustrates in detail how the upper platen 70 can be pivoted in the direction of arrow C upon retraction of the piston 62 into the cylinder 60.

Figure 5:
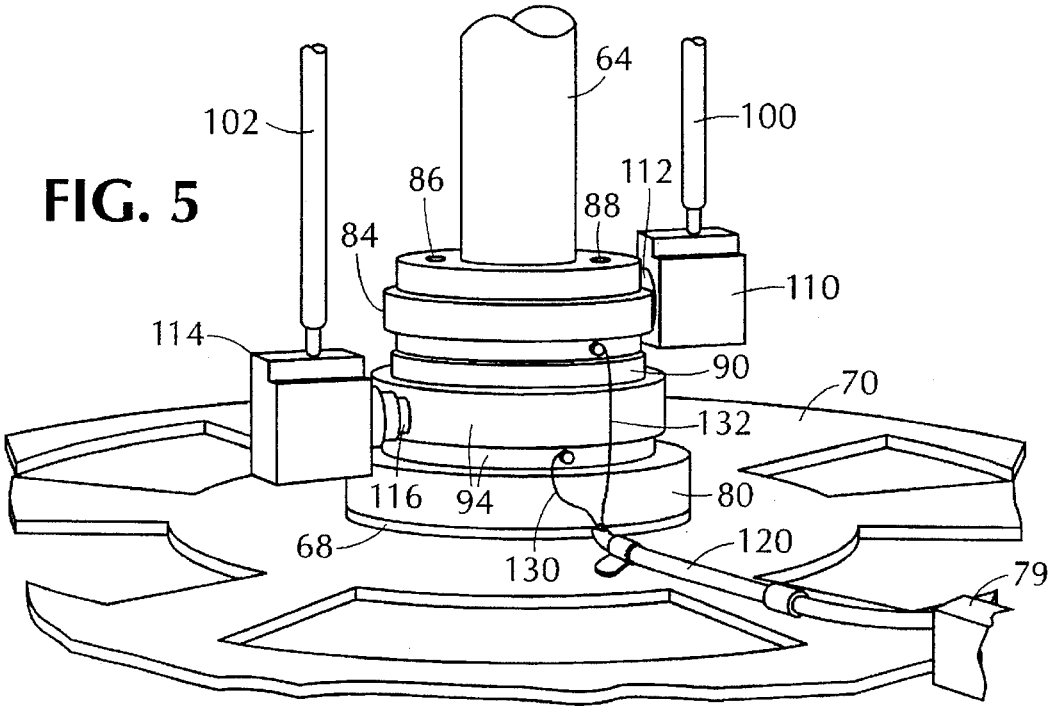
FIG. 5 is a schematic perspective view of the top portion of the upper platen showing in greater detail the electrical connection to an electromagnet.
Figure 6:
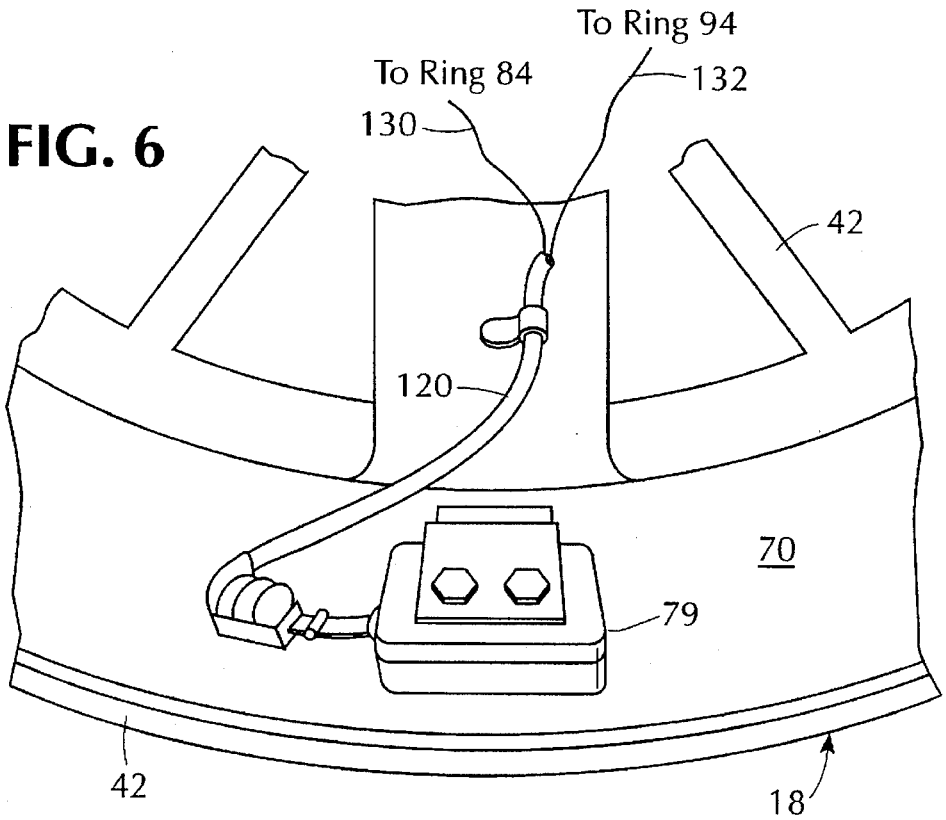
FIG. 6 is a schematic perspective view of the upper platen showing an electromagnet secured thereon.

As shown in greater detail in FIGS. 3, 5 and 6, a series of six electromagnets 79 are evenly positioned on the upper platen 70 and attract the lower platen 42 to it for locking the fabric material to be stitched between the two platens so that during stitching the platens rotate and feed material held therebetween into the stitching station 16 of the sewing head 14. FIGS. 4, 5 and shows one example of a mechanism for delivering current to the electromagnet 79. Although six electromagnets are illustrated the number used can vary depending the type of material to be clamped and the desired clamping force. The EM Series of Electromagnets manufactured by AEC Magnets have been found suitable for use with the present invention.

As illustrated in FIG. 4, a bottom insulation ring 80 is positioned around the mounting fixture 68 and secured to the mounting fixture by bolts 82. An upper conducting ring 84 rests against the top portion of the bottom insulation ring 80 as shown in FIG. 4 and includes an insulation cap ring 86 secured by bolts 88 to the bottom insulation ring 80. An insulation spacer ring 90 circumferentially encircles the bottom insulation ring 80 and is positioned below the upper conducting ring 84. The spacer ring 90 rests within a formed circumferential ledge 92 formed within the insulation housing 80. A lower conducting ring 94 is secured by bolts 96 to the bottom insulation ring 80 and separated from the upper conducting ring by the insulation spacer ring 90.

As shown is FIG. 4 an elongated support member 98 is mounted adjacent the shaft 64 and connected to the TEFLON block 66 and stationary cylinder 76, and includes opposing support rods 100, 102 which extend upward into a support plate 104 positioned on top of the cylinder 76. FIG. 1 illustrates the support plate 104 connected to the top of cylinder 76 as compared to the illustration of FIG. 2 which shows greater details of the platens. A first brush holder 110 includes an electrically conducting brush 112 which contacts the upper conducting ring 84. A second brush holder 114 has an electrically conducting brush 116 which conducts the lower conducting ring 94. As the upper platen is raised and lowered, the brush holders 110, 114 also are raised and lowered together with the support rods 100, 102 extending freely through orifices of the support member 98.

As shown in FIG. 5, conduits 120 are connected to the lower conducting ring 94 and extend to the electromagnets 79. The conduit 120 includes two wires 130, 132 inside. One wire 130 permanently attaches to the upper conducting ring 84 and the other wire attaches to the lower conducting ring. Generated current is sent through electrical wires (not shown) extending through the support tubes 102, 104 and into the brush housings 110, 114 which then conduct electrical current to the brushes 112, 116. Thus, a closed loop electrical current carrying system is formed.

In operation, an airbag or other fabric material is positioned on the lower platen 42 when the pistons 62, 78 of first and second pneumatic cylinders 60, 76 are retracted and the upper platen 70 is in its raised and extended, pivoted position. The first pneumatic cylinder 60 is then extended which brings the upper bridge arm 52 downward into a horizontal configuration as shown in FIG. 2. The piston 78 of the second pneumatic cylinder 76 is then extended which lowers the upper platen 70 into engagement with the lower platen 42. The electromagnets 82 are then energized which forces the lower platen 42 and upper platen 70 together into a tight locking arrangement which locks the upper and lower platens together and secures the airbag or other fabric material therebetween.

As the sewing head 14 stitches, it automatically advances the fabric material, thus rotating the turntable 12, which allows feeding of material into the stitching station 16. If a stitching head 14 is used that does not automatically advance the material during stitching, the optional motor assembly 40 can be connected to the timing belt pulley 38 on the lower support shaft 34, and fabric can be driven into the stitching station 16 upon forced rotation of the turntable. If the stitching head 14 needs to be replaced or serviced, the support plate can be retracted and moved linearly on the bearing rails 30, 32 so that the entire turntable 12 is positioned away from the stitching head.

It should be understood that the foregoing description of the invention is intended merely to be illustrative thereof, and that other embodiments, modifications, and equivalents may be apparent to chose skilled in the art without departing from its spirit.

That which is claimed is:

1. An apparatus for sewing comprising a sewing head having a stitching station at which stitching occurs on material fed therethrough, and a turntable for holding material to be stitched and positioned adjacent said sewing head, said turntable having upper and lower platens and having an outer perimeter with a portion of said outer perimeter extending through said stitching station, and including magnetic means along the perimeter of said turntable for holding material to be stitched, and means for rotating said turntable so that during stitching said turntable rotates and feeds material into said stitching station of said sewing head.

2. The apparatus according to claim 1 wherein said means for rotating said turntable allows said turntable to be freely rotatable.

3. The apparatus according to claim 1 including means for rotating said turntable independent of the force derived from said sewing head as the sewing head draws material through said stitching station.

4. The apparatus according to claim 1 wherein said magnetic means comprises spaced electromagnets.

5. The apparatus according to claim 1 including means for moving said turntable linearly toward and away from said sewing head.

6. An apparatus for sewing comprising a sewing head having a stitching station at which stitching occurs on material fed therethrough, and a turntable for holding material to be stitched, said turntable including a lower platen having an outer perimeter, means rotatably supporting said lower platen so that a portion of said outer perimeter of said platen extends through said stitching station, an upper platen having an outer perimeter, means supporting said upper platen in spaced relation above said lower platen, said upper platen being substantially aligned with said lower platen, and magnetic means positioned on at least one of said platens for attracting said platens for locking material to be stitched between the two platens so that during stitching, said platens rotate and feed material held therebetween into said stitching station of said sewing head.

7. An apparatus according to claim 6 including means for moving said upper platen vertically toward and away from said lower platen.

8. An apparatus according to claim 6 including means for pivotally moving said upper platen away from said lower platen to allow loading and unloading of material held between the two platens.

9. An apparatus according to claim 6 including means for moving said turntable linearly toward and away from said sewing machine.

10. An apparatus according to claim 6 wherein said magnetic means comprises spaced electromagnets positioned on said upper platen.

11. An apparatus for sewing comprising a sewing head having a stitching station at which stitching occurs on material fed therethrough, a horizontally configured support plate, a vertically aligned lower support shaft rotatably mounted on said support plate, a circularly configured lower platen secured on said support shaft and horizontally aligned thereon, said platen having an outer perimeter, said shaft and platen being positioned so that a portion of said outer perimeter of said platen extends through the stitching station, a support arm secured to said support plate and including an upper bridge arm extending above said lower platen, an upper support shaft rotatably supported by said upper bridge arm and vertically aligned with said lower support shaft, an upper platen secured to said upper support shaft, said upper platen having an outer perimeter aligned with said lower platen, means for moving said upper support shaft to move said upper platen into overlapping engagement with said lower platen, and magnetic means positioned on said upper platen for attracting said lower platen for locking material to be stitched between the two platens so that during stitching, said platens rotate and feed material held therebetween into said stitching station of said sewing machine.

12. An apparatus according to claim 11 wherein said upper bridge arm is pivotally mounted on said support arm for allowing said upper platen to pivot away from said lower platen to enable loading of material to be stitched onto said lower platen.

13. An apparatus according to claim 12 including means for moving said pivotally mounted bridge arm.

14. An apparatus according to claim 13 wherein said means for pivotally moving said bridge arm comprises a cylinder and piston.

15. An apparatus according to claim 11 wherein said means for vertically moving said upper support shaft comprises a cylinder and piston.

16. An apparatus according to claim 11 wherein said magnetic means comprises a plurality of electromagnets positioned on said upper platen.

17. An apparatus according to claim 16 including electrical contact brushes through which electrical current can be drawn, and means electrically connecting said brushes and said plurality of electromagnets.

18. An apparatus according to claim 11 including means for supporting said support plate for linear movement toward and away from said sewing head.

19. An apparatus according to claim 18 wherein said means for supporting said support plate for linear movement comprises a pair of linear bearing rails and linear bearings secured to said support plate which rest on said linear bearing rails.

20. An apparatus according to claim 11 including means for rotating said lower platen independent of the force derived from said sewing head as the sewing head draws material through the stitching station.

21. An apparatus for holding material to be stitched at the stitching station of a sewing head comprising a lower platen having an outer perimeter, means rotatably supporting said lower platen, an upper platen having an outer perimeter, means supporting said upper platen in spaced relation above said lower platen, said perimeter of said upper platen being aligned with said lower platen, and magnetic means positioned on one of said platens for attracting said platens for locking material to be stitched between the two platens so that during stitching, said platens rotate and feed material held therebetween into a stitching station of a sewing head.

22. An apparatus according to claim 21 including means for moving said upper platen vertically toward and away from said lower platen.

23. An apparatus according to claim 21 including means for pivotally moving said upper platen away from said lower platen to allow loading and unloading of material held between the two platens.

24. An apparatus for holding material to be stitched at the stitching station of a stitching head comprising, a horizontally configured support plate, a vertically aligned lower support shaft rotatably mounted on said support plate, a circularly configured lower platen secured on said support shaft and horizontally aligned, said platen having an outer perimeter, a support arm secured to said support plate and including an upper bridge arm extending above said lower platen, an upper support shaft rotatably supported by said upper bridge arm and vertically aligned with said lower support shaft, an upper platen secured to said upper support shaft, said upper platen having an outer perimeter aligned with said lower platen, means for moving said upper support shaft to move said upper platen into overlapping engagement with said lower platen, and magnetic means positioned on said upper platen for attracting said lower platen for locking material to be stitched between the two platens so that during stitching, said platens rotate and feed material held therebetween into a stitching station of a sewing machine.

25. An apparatus according to claim 24 wherein said upper bridge arm is pivotally mounted on said support arm to allow said upper platen to pivot away from said lower platen to enable loading of material onto said lower platen.

26. An apparatus according to claim 25 including means for pivoting said upper bridge arm.

27. An apparatus according to claim 26 wherein said means for pivotally moving said support arm comprises a cylinder and piston.

28. An apparatus according to claim 24 wherein said means for vertically moving said upper support shaft comprises a cylinder and piston.

29. An apparatus according to claim 24 wherein said magnetic means comprises a plurality of electromagnets positioned on said upper platen.

30. An apparatus according to claim 24 including electrical contact brushes positioned on said upper shaft through which electrical current can be drawn, and means electrically connecting said brushes and said plurality of electromagnets.

31. An apparatus according to claim 24 including means for supporting said support plate for linear movement.

32. An apparatus according to claim 31 wherein said means for supporting said support plate for linear movement comprises a pair of linear bearing rails and linear bearings secured to said support plate which rest on said linear bearing rails.

33. An apparatus according to claim 24 including means mounting said lower shaft and platen to said support plate.

* * * * *